US007780830B2

(12) United States Patent
Haluzak et al.

(10) Patent No.: US 7,780,830 B2
(45) Date of Patent: Aug. 24, 2010

(54) ELECTRO-WETTING ON DIELECTRIC FOR PIN-STYLE FLUID DELIVERY

(75) Inventors: Charles C Haluzak, Corvallis, OR (US); Bradley Bower, Junction City, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1228 days.

(21) Appl. No.: 11/228,699

(22) Filed: Sep. 16, 2005

(65) Prior Publication Data

US 2006/0081643 A1 Apr. 20, 2006

Related U.S. Application Data

(60) Provisional application No. 60/620,215, filed on Oct. 18, 2004.

(51) Int. Cl.
*F04B 19/00* (2006.01)

(52) U.S. Cl. ..... 204/450; 204/600; 422/100; 436/180

(58) Field of Classification Search ..... 204/450, 204/600; 345/107; 435/189; 422/99, 100; 436/55, 180

See application file for complete search history.

(56) References Cited

U.S. PATENT DOCUMENTS 5,750,015 A * 5/1998 Soane et al. ..... 204/454
6,150,456 A * 11/2000 Lee et al. ..... 524/606
6,286,938 B1 * 9/2001 Okano et al. ..... 347/55
6,473,492 B2 10/2002 Prins
6,565,727 B1 * 5/2003 Shenderov ..... 204/600
6,686,207 B2 * 2/2004 Tupper et al. ..... 436/174
7,037,812 B2 * 5/2006 Kawahara et al. ..... 438/500
7,097,810 B2 * 8/2006 Chang et al. ..... 422/100
2002/0196558 A1 * 12/2002 Kroupenkine et al. ..... 359/665

OTHER PUBLICATIONS

Belaubre et al. (Cantilever-based microsystem for contact and non-contact deposition of picoliter biological samples, Elsevier, Sensors & Actuators, available on-line Nov. 27, 2003, 130-135).*

Shapiro, "Modeling of Electrowetted Surface Tension . . . ", IEEE, 2003, pp. 201-205.

Cho, "Creating, Transporting, Cutting, and Merging Liquid . . . ", Journal of Microelectromechanical Systems, vol. 12, No. 1, Feb. 2003, pp. 70-80.

(Continued)

*Primary Examiner*—Alexa D Neckel
*Assistant Examiner*—Jennifer Dieterle

(57) ABSTRACT

A method of delivering fluid can include using electro-wetting effects to pick-up, transport, and/or deliver discrete volumes of fluid. Voltage can be applied across a fluid contact area having a conductive substrate and a dielectric material with an outer surface. The outer surface can have a native interfacial surface tension state and a voltage induced second state having a reduction in interfacial surface tension. A fluid can be contacted such that a volume of fluid adheres to the outer surface of the fluid contact area when the voltage is applied. Subsequently, the voltage can be adjusted such that at least a portion of the volume of fluid is delivered to a receiving location.

21 Claims, 2 Drawing Sheets

OTHER PUBLICATIONS

Cho, "Particle Separation and Concentration Control . . . ", IEEE, 2003, pp. 686-689.

Cosnowski, "Pyrosequencing of DNA using Electrowetting on Dielectrics", Stanford Nanofabrication Facility, National Nanofabrication Users Network, pp. 58-59.

Zhang, "Bias-graded deposition of diamond-like carbon . . . ", Diamond and Related Materials 13, 2004, pp. 867-871.

Lee, "Electrowetting and electrowetting-on-dielectric for Microscale Liquid Handling", Sensors and Actuators A 95, 2002, pp. 259-268.

Jones, "Electrostatics and the Lab on a Chip", IoP Physics Congress (Electrostatics 2003), Edinburgh, Mar. 2003, pp. 1-8.

Tsai, "A Silicon-Micromachined Pin for Contact Droplet Printing", IEEE, 2003, pp. 295-298.

Shapiro, "Equilibrium Behavior of Sessile Drops Under Surface Tension . . . ", Journal of Applied Physics, vol. 93, No. 9, May 1, 2003, pp. 5794-5811.

Jones, "Frequency-Dependent Electromechanics of Aqueous Liquids . . . ", Langmuir, vol. 20, No. 7, 2004, pp. 2813-2818.

Fan, "Manipulation of Multiple Droplets on NxM Grid . . . ", IEEE, 2003, pp. 694-697.

Yi, "Soft Printing of Droplets Digitized by Electrowetting", IEEE, 2003, 12th Intl Conf on Solid State Sensors, Acuators & Microsystems, Boston, Jun. 8-12, 2003, pp. 1804-1807.

* cited by examiner

ELECTRO-WETTING ON DIELECTRIC FOR PIN-STYLE FLUID DELIVERY

CLAIM OF PRIORITY

This application claims the benefit of U.S. Provisional Application No. 60/620,215, filed on Oct. 18, 2004, and titled ELECTRO-WETTING ON DIELECTRIC FOR PIN-STYLE FLUID DELIVERY.

FIELD OF THE INVENTION

The present invention relates generally to fluid delivery devices. More particularly, the present invention relates to fluid delivery devices useful for manipulating very small volumes of fluid and methods for the production of such devices.

BACKGROUND OF THE INVENTION

Currently, a variety of fluid delivery devices are available for acquiring and delivering small volumes, i.e. less than 1 mL. These methods include micro-syringes, MEMS devices, pin-style devices, and other known devices. Pin-style devices are commonly used in arrays to perform repeated fluid manipulation steps. Some of the more well-known applications for these pin-style devices include DNA assays, protein sequencing, replicating genome and microbial libraries, and the like. Typical pin-style devices include a metal pin or needle which is specifically designed for delivering a given volume of fluid. Further, these devices are also designed for manipulation of either hydrophobic or hydrophilic fluids. As such, these devices are typically fixed designs such that separate pins are required to change delivery volumes or fluid type. These devices are also often limited in design shape based on available machining techniques; thus, there are limits as to how small the volumes of fluid can be. Further, repeatability of pin shape can vary slightly from one pin to the next. As a result, as fluid volumes decrease, repeatability using an array of such pins can in some cases become a significant problem. Additionally, pin-style devices tend to suffer from a drift in delivery volumes which is related to a change in the surface energy of the pins as a result of interaction with the fluid. Various approaches such as cleaning the pins and statistical methods can help to reduce these difficulties. However, these approaches often entail additional time and expense.

For these and other reasons, the need exists for improved methods and systems which can be used to deliver very small volumes of fluid, which have a high degree of repeatability, increase control and range of delivery volumes, and are convenient to manufacture.

SUMMARY OF THE INVENTION

It would be advantageous to develop improved methods and materials which can be used to deliver small volumes of fluid. In one aspect of the present invention, a method of delivering fluid can include using electro-wetting effects to pick-up, transport, and/or deliver discrete volumes of fluid. Voltage can be applied across a fluid contact area having conductive substrate and a dielectric material with an outer surface. The outer surface can have a native interfacial surface tension state and a voltage induced second state having a reduction in interfacial surface tension. A fluid can be contacted such that a volume of fluid adheres to the outer surface of the fluid contact area when the voltage is applied. Subsequently, the voltage can be adjusted such that at least a portion of the volume of fluid is delivered to a receiving location. The applied voltage can be variably adjusted to affect the hydrophobicity of the contact surface with respect to the fluid. Thus, a single fluid delivery device can be capable of delivering a range of fluid volumes, depending on the applied voltage and/or optional discrete addressable conductive substrates.

Additional features and advantages of the invention will be apparent from the following detailed description, which illustrates, by way of example, features of the invention.

BRIEF DESCRIPTION OF THE DRAWINGS

Aspects of the invention can be better understood with reference to the following drawings. The components in the drawings are not necessarily to scale, with emphasis instead being placed upon clearly illustrating the principles of the present invention.

DETAILED DESCRIPTION OF THE PREFERRED EMBODIMENT(S)

Figure 1A:
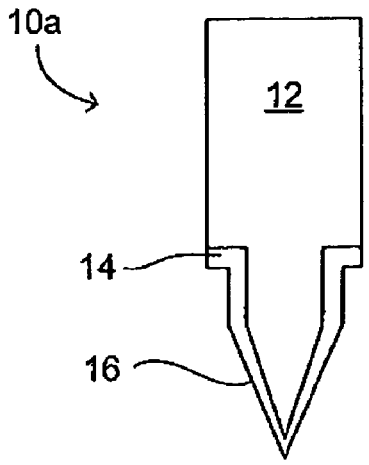
FIG. 1A illustrates a side cross-sectional view of a needle pin in accordance with an embodiment of the present invention.

Reference will now be made to exemplary embodiments and specific language will be used herein to describe the same. It will nevertheless be understood that no limitation of the scope of the invention is thereby intended. Alterations and further modifications of the inventive features described herein, and additional applications of the principles of the invention as described herein, which would occur to one skilled in the relevant art and having possession of this disclosure, are to be considered within the scope of the invention. Further, before particular embodiments of the present invention are disclosed and described, it is to be understood that this invention is not limited to the particular process and materials disclosed herein as such may vary to some degree. It is also to be understood that the terminology used herein is used for the purpose of describing particular embodiments only and is not intended to be limiting, as the scope of the present invention will be defined only by the appended claims and equivalents thereof.

In describing and claiming the present invention, the following terminology will be used.

The singular forms "a," "an," and "the" include plural referents unless the context clearly dictates otherwise. Thus, for example, reference to "a fluid contact area" includes reference to one or more of such areas.

As used herein, "hydrophobic" when referring to a material, refers to the degree of wetting of a surface of the material by a corresponding fluid. The specific degree of hydrophobicity can depend on the properties of the surface of the material, the fluid, and to some extent, atmospheric conditions. However, as a general guideline, a hydrophobic surface tends to repel water, while a hydrophilic surface is wetted by water or other fluids. Thus, hydrophobic, as used herein, can be relative to both the fluid and the material. As such, a specific material can be hydrophobic with respect to some fluids, and not others.

As used herein, "native interfacial surface tension state" refers to an electrically neutral state with no applied voltage and no stored charge. Interfacial surface tension is a function of the surface tension of a surface and a corresponding contacting fluid, as well as the surrounding gaseous atmosphere. Thus, in accordance with the present invention, a native interfacial surface tension refers to the interfacial surface tension which is present between a surface and a fluid in the absence of an applied voltage, i.e. without induced electro-wetting effects. For example, a fluid having a high contact angle on a particular surface can be delivered using a hydrophobic surface through induction of electro-wetting on dielectric effects in accordance with the present invention. In this case, the native interfacial surface tension state is not conducive to adherence and wetting of the fluid to the surface. However, upon application of an applied voltage, the interfacial surface tension is reduced sufficiently to enhance adherence of the fluid thereto.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 μL to about 500 μL should be interpreted to include not only the explicitly recited limits of 1 μL and about 500 μL, but also to include individual values such as 2 μL, 3 μL, 4 μL, and sub-ranges such as 10 μL to 50 μL, 20 μL to 100 μL, etc.

In accordance with the present invention, a method of delivering fluid can include using electro-wetting effects to pick-up, transport, and/or deliver discrete volumes of fluid. In one aspect, a method of delivering fluid can include applying a voltage across a fluid contact area. The fluid contact area can include a dielectric material and an outer surface. The outer surface can have a native interfacial surface tension state and a voltage induced state having a reduction in interfacial surface tension. Further, the outer surface can be the surface of the dielectric material, or can be provided through the addition of a coating layer. As discussed in more detail below, the fluid contact area can have a wide variety of configurations which achieve various advantages in delivery volumes, potential types of fluids, fluid release characteristics, manufacturing ease, and other advantages.

In one embodiment, a fluid can be contacted with at least a portion of the fluid contact area such that a volume of fluid adheres to the outer surface of the fluid contact area when the voltage is applied. In one aspect, the voltage can be applied across the fluid contact area prior to contacting at least a portion of the fluid. Alternatively, the voltage can be applied subsequent to the step of contacting the fluid.

A receiving location can be oriented in proximity to the volume of fluid, either through moving the fluid contact area and/or the receiving location. Subsequently, the voltage can be adjusted, typically by reducing the voltage, such that from at least a portion to all of the volume of fluid is delivered to the receiving location.

In one aspect of the present invention, an electro-wetting fluid delivery device can include an electrically conductive substrate and a fluid contact area on the substrate. The fluid contact area can include a dielectric layer which can be adjacent the conductive substrate. An electric field source can be operatively connected to the electrically conductive substrate and configured for producing an electric field across at least a portion of the fluid contact area. Typically, the electric field can be produced across the portions of the fluid contact area for which a change in hydrophobicity of a contacted fluid and/or contact surface are desired.

In one detailed aspect of the present invention, the fluid contact area can be a surface of a fluid drop delivery pin. The fluid contact area can be an external surface of a fluid delivery pin. Alternatively, the fluid contact area can be an internal capillary surface of a capillary fluid delivery pin. Non-limiting examples of suitable configurations for the fluid contact area include rod, needle, capillary, slotted, grooved, threaded, or combinations thereof.

Referring now to FIGS. 1A through 1E, several examples of suitable fluid delivery pin configurations are illustrated. FIG. 1A shows a needle fluid delivery pin 10*a* having a conductive substrate 12. A dielectric coating 14 can be formed around the conductive substrate. The fluid contact area 16 can be any portion of the fluid delivery pin which can be used to adhere fluid. Typically, a specific portion of the fluid delivery pin can be designed for holding a volume of liquid at an outer surface of the dielectric coating.

Figure 1B:
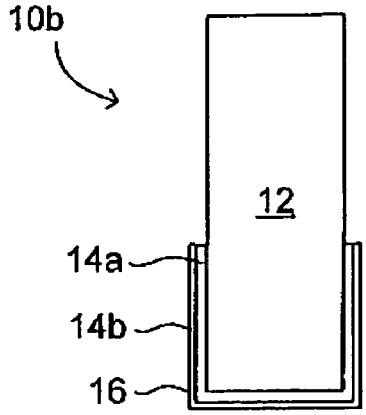
FIG. 1B illustrates a side cross-sectional view of a rod pin in accordance with an embodiment of the present invention.
Figure 1C:
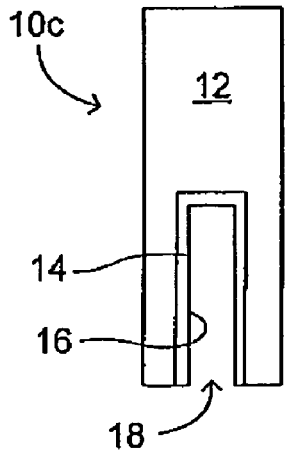
FIG. 1C illustrates a side cross-sectional view of a slotted pin in accordance with an embodiment of the present invention.

FIG. 1B shows a rod fluid delivery pin 10*b* having a conductive substrate 12, with a multi-layered dielectric coating formed around a portion of the conductive substrate forming a fluid contact area 16. The multi-layered dielectric coating includes a base dielectric layer 14*a* and an outer dielectric coating 14*b* which has a native hydrophobic interfacial surface tension. Although the multi-layered dielectric coating is only shown on FIG. 1B, it will be understood that such dielectric coatings can be used in any of the other disclosed fluid delivery devices. FIG. 1C shows another alternative configuration of a slotted delivery pin 10*c*. The dielectric coating 14 can be formed on inner surfaces of a slot 18 formed in the conductive substrate 12. In this configuration, the fluid contact area 16 can predominantly include inner surfaces within the slot. Slotted fluid delivery pins can alternatively include a plurality of slots which can be parallel, perpendicular, or any other angle with respect to adjacent slots which is functional for delivering fluid. Further, the depth of the slot can be varied in order to affect the range of volumes which the fluid delivery pin can accommodate.

Figure 1D:
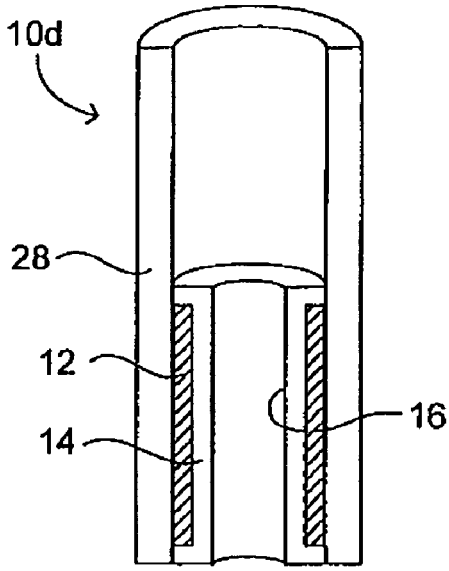
FIG. 1D illustrates a side cross-sectional view of a capillary pin in accordance with an embodiment of the present invention.

A capillary fluid delivery pin 10*d* is shown in FIG. 1D. The pin can include a cylindrical pin body 28. At a delivery end of the pin, a conductive substrate 12 can be placed on the inner surface of the pin body. In the embodiment shown, the conductive substrate is a cylinder, however this is not required. A dielectric coating 14 can be formed over the conductive substrate such that the fluid contact area 16 is within the capillary cavity.

Figure 1E:
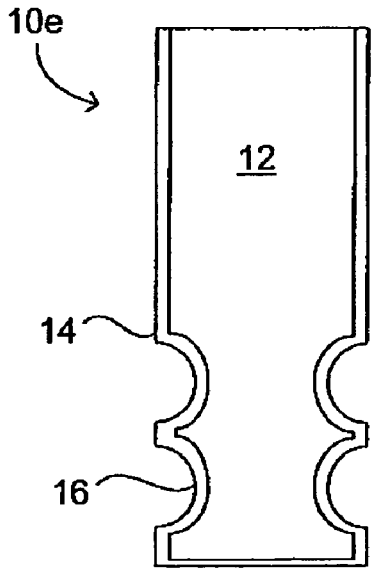
FIG. 1E illustrates a side cross-sectional view of a grooved pin in accordance with an embodiment of the present invention.

FIG. 1E illustrates yet another embodiment of the present invention as a grooved fluid delivery pin 10*e*. The conductive substrate 12 can have one or more grooves which typically extend circumferentially around the pin. A dielectric coating 14 can be coated over the conductive substrate to form a fluid contact area 16. In this embodiment, the grooved spaces can hold the dominant portions of the fluid; however, other portions of the dielectric coating can also retain fluid.

The dielectric layer can extend as shown in the figures or can be varied. For example, in order to affect the maximum volume, the dielectric layer can cover only portions of the pin tips. Limiting the dielectric layer, or at least the outer surface, to defined areas can also reduce or prevent creep of fluid along the pin contours.

In an additional alternative aspect, although the conductive substrates shown in FIGS. 1A, 1B, 1C, and 1E are shown as a bulk solid, i.e. non-hollow, this is not required. Often manufacturing convenience or other factors will lead to production using a bulk solid conductive substrate. However, the conductive substrate can be hollow, or can be formed on a separate material. For example, a polymeric or non-conductive core can be coated or layered with a conductive metal. Subsequently, a dielectric layer can be formed on the conductive substrate. In addition, the cross-sectional shapes of the fluid delivery pins can be any practical shape such as, but not limited to, round, square, rectangular, elliptical, or the like. In many embodiments, the cross-sectional shape can be circular. The specific configurations discussed above are merely exemplary of the type of fluid delivery devices which can be used in connection with the present invention. For example, pin tips can have additional contours such as conical, frusto-conical, bevel, curved, or the like. Those skilled in the art will recognize various additional configurations which can be useful for particular applications.

In an additional aspect of the present invention, the fluid delivery device can include a plurality of electro-wetting fluid delivery devices arranged in an array on a common pin block. Typically, the common pin block can be attached to a robotic arm or other manipulable system which can be used to automate fluid pick-up and drop delivery cycles. Such an arrangement can enable fluid transfer and manipulation of small volumes of fluid on a mass scale, e.g., dozens to thousands of fluid volumes per pick-up and drop cycle, depending on the size of the array. Further, each of the fluid delivery devices within the array can be individually electrically addressable such that individual pins can be activated independent of others. This type of configuration can allow for a time lapse between pick-up for individual pins or groups of pins. Additionally, only a portion of the array can be used for a given fluid delivery step, without resorting to replacement of the entire pin block.

Each configuration and design of the fluid contact area and associated fluid delivery pins can affect the performance and delivery characteristics. Several factors which can affect performance can include fluid contact area contours, pin diameter, surface cleanliness and dangling bond energy of the outer surface, surface tension of the fluid, insertion depth into a source of fluid, removal speed from a source of fluid, delivery impact speed (if applicable), and other known factors. In accordance with the present invention, electro-wetting can also be used to dramatically affect the fluid delivery performance.

The electrically conductive substrate can comprise any conductive metal or material which can be incorporated into a fluid delivery device. Non-limiting examples of suitable conductive materials include stainless steel, copper, doped-polysilicon, aluminum, gold, and conductive alloys or composites thereof. In one specific aspect, the conductive material can be stainless steel. Typically, the devices of the present invention can be formed from solid rods which are machined, laser cut, or otherwise shaped to a desired tip contour. However, in some embodiments, the conductive substrate can be a layer or coating formed on a second material. For example, the capillary fluid delivery device 10*d* as shown in FIG. 1D can be formed by interference fitting a small conductive metal sleeve as the conductive substrate 12 within the cylindrical pin body 28. Alternatively, the conductive substrate can be formed by deposition methods such as, but not limited to, chemical vapor deposition, decomposition of a metal salt, physical vapor deposition, electroless deposition, electroplating, or the like.

The dielectric layer can be formed of any material which acts as an electrical insulator at typical operating conditions. Suitable dielectric materials can include, but are not limited to, polytetrafluoroethylene, silicon nitride, silicon dioxide, silicon oxy-nitride, fluorosilicate glass, glasses, diamond-like carbon (having a high degree of $sp^3$ bonding), polystyrene, fluorinated polyimides, parylene (poly-p-xylylene or a derivative of poly-p-xylylene), polyarylene ether, siloxanes, silsesquioxanes, aerogels, xerogels, polyimide, epoxy, polyurethane, polyester, cyanoacrylate, polynorbornenes, fluorinated polymers, and combinations thereof. Often the dielectric layer can comprise a material having a dielectric constant of greater than about 3 and often greater than about 15 and, in most cases, less than about 150. Typically, dielectric materials having a greater dielectric constant require less applied voltage in order to achieve a change in contact angle than dielectric materials having a lower dielectric constant. Further, many dielectric materials which have a high dielectric constant are also hydrophilic materials.

Thus, in can be desirable to produce a multi-layered dielectric portion. For example, a first base dielectric layer can be formed of a material having a relatively high dielectric constant. Typically, inorganic dielectric materials can form suitable base dielectric layers. A second dielectric layer which is also hydrophobic can be present on the base dielectric layer. Frequently, organic dielectric materials can be suitable for use as the second dielectric layer. In one example, a silicon oxide or silicon nitride layer can be overlaid with a thin layer of polytetrafluoroethylene. In this way, breakdown or arcing across the dielectric can be reduced or eliminated by reducing the voltage applied across materials having low dielectric constants, while also providing a hydrophobic surface in accordance with the present invention. As a general matter, inorganic dielectric materials can be useful as the base layer and tend to have relatively high dielectric constants, e.g., above about 15. In contrast, organic dielectric materials, despite typically lower dielectric constants, tend to be useful to provide a surface which is hydrophobic.

In one aspect, the dielectric material can be a silicon containing material. Such materials can be coated on the conductive substrate using known vapor deposition techniques, including plasma-assisted and/or ion-assisted processes. Further, vapor deposition techniques such as chemical and physical vapor depositions can be economically used to produce suitable coatings. Non-limiting examples of suitable vapor deposition techniques include, but are not limited to, hot filament CVD, rf-CVD, laser CVD (LCVD), metal-organic CVD (MOCVD), sputtering, thermal evaporation PVD, ionized metal PVD (IMPVD), electron beam PVD (EBPVD), reactive PVD, plasma enhanced CVD (PECVD), atomic layer deposition (ALD), or the like.

In one aspect, the dielectric material can be polytetrafluoroethane and/or silicon-based. These types of dielectric coatings are readily formed at reasonable costs. In another aspect, the dielectric material can be diamond-like carbon (DLC). Such DLC coatings can be particularly suitable due in part to relatively durable mechanical strengths, as well as good electrical insulation properties (E of about 5.5). Additionally, DLC tends to be highly inert when exposed to most fluids and can be formed to have a contact angle of 90° or greater, e.g., by increased ion beam energy.

The dielectric coating can have any thickness which is sufficient to provide electrically insulating effects between the conductive substrate and the fluid. Further, in order to extend the useful life and reliability of the fluid delivery devices it can be desirable to extend the thickness to enhance mechanical strength. Although suitable thicknesses can vary based on the dielectric material or other considerations, typical thicknesses can range from about 0.1 μm to about 1.0 μm for the base dielectric layer. The optional second dielectric layer, e.g., an organic layer, can have a thickness from about 100 angstroms to about 1000 angstroms.

In accordance with the present invention, the fluid contact area can have an outer surface which has a water affinity property wherein the interfacial surface tension results in non-wetting of the surface by the fluid. Many of the dielectric materials listed above are also hydrophobic with respect to most fluids of interest. However, debris or other impurities can interfere with the hydrophobicity between the contact surface and the fluid. Alternatively, a separate layer of hydrophobic material can be formed on the dielectric material. This can be desirable for a variety of reasons. For example, some dielectric materials can be hydrophilic or can react with fluids of interest. Therefore, an additional protective layer can be formed to prevent adverse interaction between the fluid and the dielectric. The additional protective layer can also be an electrically insulating material.

In accordance with the present invention, it can be desirable to have a contact surface which has a native interfacial surface tension state, such that fluids do not tend to adhere thereto. As a general guideline, materials can be chosen such that the outer surface has a contact angle with a fluid to be delivered of about 90° or greater. This helps to reduce contamination during repeated use, and also improves release rate of the fluid once the contact surface returns to the native interfacial surface tension state. Optional surface treatments can include oils or other materials such as insulating oil (MIDEL 7131) can be used to reduce hysteresis and improve repeatability. This is in contrast to standard fluid delivery pins which coat pins with a material which reduces interfacial surface tension between the pin and the fluid. In accordance with the present invention, application of an electric potential across the contact surface changes the interfacial properties to create a voltage-induced state which has a reduced interfacial surface tension.

More specifically, either before or after contact with a fluid, an electric field can be applied across the fluid contact area. In accordance with a phenomena referred to as electro-wetting on dielectric (EWOD), under an applied voltage, the hydrophobic surface behaves in a more hydrophilic manner. Without being bound to any particular theory, the changes in hydrophobicity appear to be at least partially due to minimization of charge distribution in the fluid to reduce the distance between the separated charges. The applied voltage changes the free energy of the surface and induces a change in the wettability of the outer surface and the contact angle of the fluid. The interfacial surface tension can be characterized mathematically by Lippmann's equation:

$$\gamma=\gamma_o-0.5cV^2$$

where c is the capacitance of the dielectric layer, V is the applied DC voltage, γ is the voltage-induced interfacial surface tension, and $\gamma_o$ is the native interfacial surface tension. Thus, the native interfacial surface tension state and the voltage induced second state can be viewed as both changes in properties of the fluid and/or contact surface properties and associated substrate materials.

Once the applied voltage is removed, the voltage induced second state remains until the circuit is shorted. Thus, the volume of fluid can be transported without changing the hydrophobicity of the fluid contact surface and without an applied voltage. The volume of fluid can be oriented above a receiving location such as a plate, test tube, or other container. The voltage can then be adjusted such that the hydrophobicity of the contact surface changes. In one aspect, the step of adjusting the voltage returns the outer surface to the native interfacial surface tension state. As such, the volume of fluid is substantially completely removed from the contact surface. In some cases, this can include creating a short circuit between the fluid and the conductive substrate. Alternatively, the voltage can be adjusted to partially increase interfacial surface tension. In this way, only a portion of the drop can be released or the rate of release can be reduced.

The volume of fluid retained on the fluid delivery device can depend greatly on the surface configuration as discussed above. However, as a general guideline, the volume of fluid can have a volume from about 100 pL to about 100 μL, such as from about 250 pL to about 50 μL. In an additional aspect of the present invention, the electric field source can be configured for variable adjustment of the applied voltage or electric field. In this way, the hydrophobicity of the contact surface can be varied to correspond with a range of volumes. Thus, a single fluid delivery device can be capable of delivering a wide range of fluid volumes, depending on the applied voltage and/or a plurality of discrete addressable conductive substrates as discussed further below. Again, the exact range can depend on the specific configuration. However, as an example, ranges of fluid volumes deliverable from a given pin design include, but are certainly not limited to, about 1 pL to about 500 pL, about 1 μL to about 50 μL; or the like.

Thus, the voltage can be variably adjusted to correspond to a predetermined volume of fluid. The magnitude of the applied electric field can be any field strength which is sufficient to cause a change in hydrophobicity sufficient to retain a repeatable volume of fluid thereon. Generally, the magnitude of the electric potential can be from about 10 V to about 200 V, although values outside this range can be suitable for fluid-contact surface systems having very low or very high interfacial surface tensions, or depending on properties of the dielectric layers.

In an alternative embodiment of the present invention, the fluid contact surface can include a plurality of discrete individually addressable areas which can be independently controlled to adjust interfacial surface tension. The discrete areas can be separately addressable conductive substrates which are formed along the fluid contact areas. This configuration can be applied in embodiments where the fluid contact area is an external surface of a pin and in embodiments where the primary fluid contact areas are internal surfaces such as, but not limited to, those shown in FIGS. 1C and 1D. Thus, the total fluid contact area which can be wetted by a particular fluid can be adjusted by applying a voltage across selected discrete addressable areas. Thus, in one aspect, voltage can be applied to adjacent discrete individually addressable areas sequentially from lower areas adjacent the fluid to areas farther up the fluid contact area. In this way, the volume of fluid which is delivered can be adjusted by using a specific number of available discrete areas. Thus, a single fluid delivery device can be configured for delivery of a range of fluid volumes for a given fluid. Similarly, once a fluid is wetted to a fluid contact area having a plurality of discrete addressable areas, each area can be returned to its native interfacial tension state simultaneously or sequentially. For example, sequential shorting of discrete areas starting with uppermost areas down to the lower areas can increase the rate of delivery of the fluid from the device. The number of discrete individually addressable areas is not particularly limited and can vary from two to several dozen. However, manufacturing costs and convenience in operation can make from about two to about ten discrete areas per fluid delivery device more likely.

The fluid delivery devices of the present invention can allow for improved range of fluid volume delivery options. However, volume drift and hysteresis effects can still reduce repeatability. Therefore, in accordance with the present invention, the fluid delivery device can further include a feedback system operatively connected to the electric field source and configured for variable adjustment of the electric potential based on measurement of the resistance, impedance, or capacitance of the dielectric and fluid above the electrode. Specifically, the fluid volume can be correlated to capacitance measurements across the droplet. Therefore, any drift in volume can be controlled using standard feedback designs, e.g., proportional, proportional-integral, etc., to adjust the applied voltage to maintain the fluid volumes at a substantially constant value over extended periods of use.

Figure 2A:
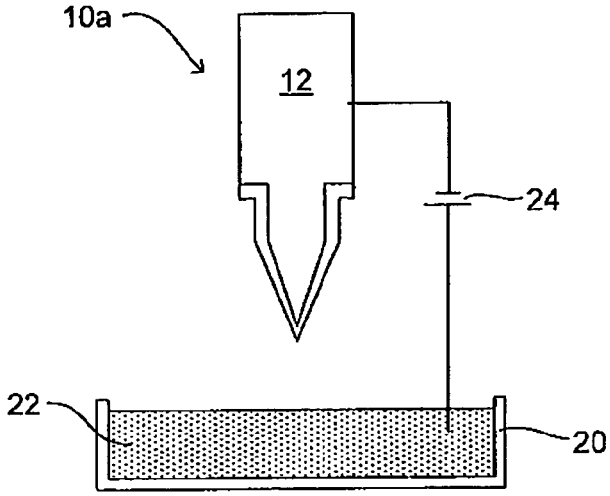
FIG. 2A illustrates a side cross-sectional view of an electro-wetting fluid delivery device according to an embodiment of the present invention.

FIG. 2A illustrates a fluid delivery system in accordance with one embodiment of the present invention. A needle fluid delivery device 10*a* is shown, as described previously in FIG. 1A. A fluid source container 20 can retain a fluid 22. Further, in this embodiment, an electric field source 24 can be operatively connected to the electrically conductive substrate 12 and the fluid.

Figure 2B:
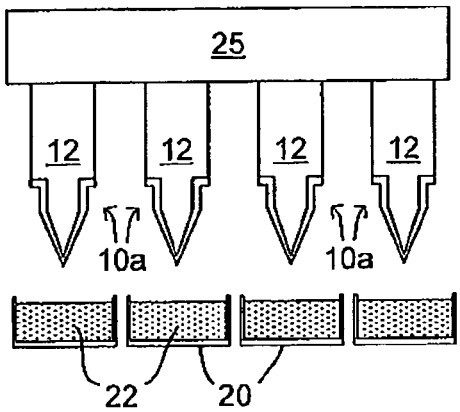
FIG. 2B illustrates a side cross-sectional view of an array of electro-wetting fluid delivery devices in accordance with an embodiment of the present invention.

Similarly, FIG. 2B shows an array of fluid delivery devices 10*a* secured to a common pin block 25. As discussed previously, such an array can be almost any size and can be a two dimensional array which allows for fluid delivery of small volumes on a large scale with a high degree of repeatability.

Figure 3A:
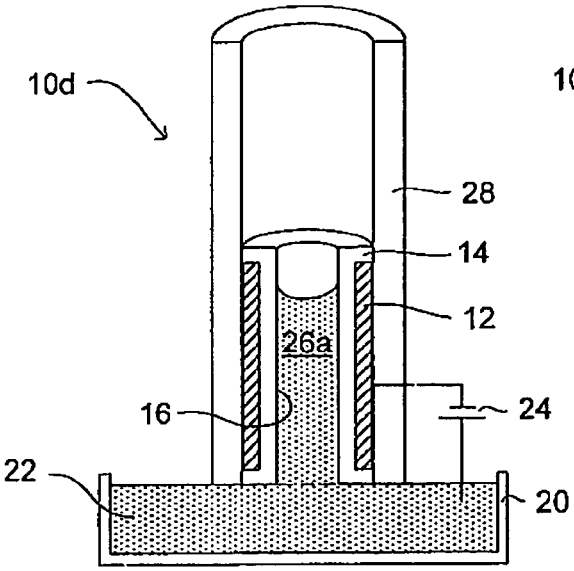
FIG. 3A illustrates a side cross-sectional view of an electro-wetting fluid delivery device according to another embodiment of the present invention.

FIG. 3A illustrates a fluid delivery system in accordance with an alternative embodiment of the present invention. A capillary fluid delivery device 10*d* is shown in contact with a source fluid 22 held by a fluid source container 20. An electric field source 24 is shown operatively connected to the conductive substrate 12 and the fluid. As the capillary fluid delivery device contacts the fluid, a volume of fluid 26*a* enters the open space driven by capillary action which is augmented by electro-wetting of the fluid contact area 16 on the inner surfaces of the capillary fluid delivery device. In the embodiment shown, cylindrical pin body 28 can be electrically insulating so as to not short the circuit across the fluid contact area and dielectric layer 14. Alternatively, the dielectric layer can be extended around the outside to the cylindrical pin body to prevent contact of fluid directly with the pin body.

Figure 3B:
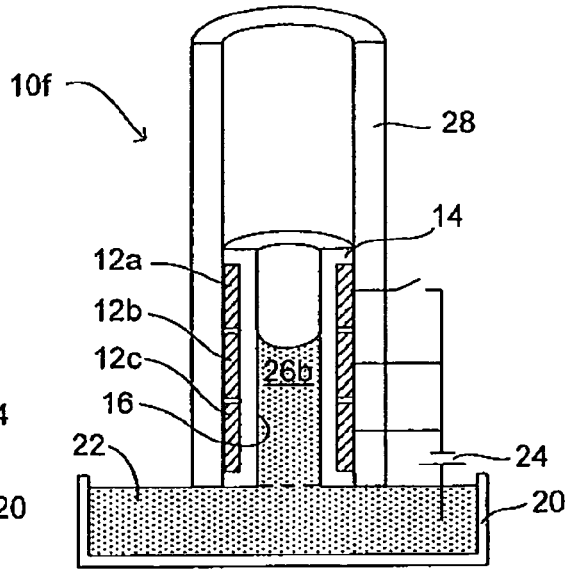
FIG. 3B illustrates a side cross-sectional view of an electro-wetting fluid delivery device having a plurality of discrete individually addressable areas according to an embodiment of the present invention.

FIG. 3B illustrates one embodiment of a fluid delivery device having a plurality of discrete individually addressable areas. It will be understood that this principle can also be applied to any configuration of fluid contact area such as, but not limited to, those found in FIGS. 1A through 1E and those discussed previously. Referring now to FIG. 3B, a capillary fluid delivery device 10*f* is shown in contact with a source fluid 22 held by a fluid source container 20. An electric field source 24 is shown operatively connected to a plurality of discrete individually addressable conductive substrates 12*a*, 12*b*, and 12*c* and the fluid. Each of the conductive substrates can be individually controlled and can be separated by a non-conductive spacer. As shown in FIG. 3B, the lower two conductive substrates, i.e. 12*c* and 12*b*, are turned on such that the outer surface adjacent these areas exhibits electro-wetting, while conductive substrate 12*a* is disconnected from the electric field source and is thereby maintained in its native hydrophobic interfacial surface tension state. As the capillary fluid delivery device contacts the fluid, a volume of fluid 26*b* enters the open space driven by capillary action which is augmented by electro-wetting of the fluid contact area 16 on the inner surfaces of the capillary fluid delivery device which have an applied electric field. Thus, in the embodiment shown, at least three different volumes can be delivered using the same fluid delivery device. For example, applying voltage to only conductive substrate 12*c* would correspond to a first volume not shown, conductive substrates 12*c* and 12*b* to a second volume 26*b*, as shown, and conductive substrates 12*c*, 12*b*, and 12*a* to a third volume which roughly corresponds to the volume 26*a* shown in FIG. 3A. Further, the fluid 26*b* can be delivered in a plurality of volumes to different destinations (or at different times to the same destination) by shorting one or more of the conductive substrates while maintaining the wetting properties of the remaining conductive substrates.

The following examples illustrate exemplary embodiments of the invention. However, it is to be understood that the following are only exemplary or illustrative of the application of the principles of the present invention. Numerous modifications and alternative compositions, methods, and systems may be devised by those skilled in the art without departing from the spirit and scope of the present invention. The appended claims are intended to cover such modifications and arrangements. Thus, while the present invention has been described above with particularity, the following examples provide further detail in connection with what is presently deemed to be practical embodiments of the invention.

EXAMPLES

Example 1

A set of fluid delivery slot pins which are 100 nL (0.787 mm diameter) and 10 μL (3.18 mm diameter), available from VP Scientific, are placed in a vacuum chamber. A 4 μm coating of diamond-like carbon is grown on the pins using PECVD conditions such that the contact angle with water is about 109°. Conductive wires are coupled to the stainless steel ends distal to the slots. A variable voltage source is electrically connected to the wires and a plate of distilled water. An applied voltage of 150 V results in repeatable delivery of water volumes to a second plate.

Example 2

A set of fluid delivery slot pins which are 100 nL (0.787 mm diameter) and 10 μL (3.18 mm diameter), available from VP Scientific, are placed in a vacuum chamber. A 1 μm coating of silicon dioxide is grown on the pins using vapor deposition conditions. Subsequently, polytetrafluoroethylene is deposited on the silicon dioxide layer to a thickness of 200 angstroms. Conductive wires are coupled to the stainless steel ends (distal to the slots). A variable voltage source is electrically connected to the wires and a plate of distilled water. An applied voltage of 100 V results in repeatable delivery of water volumes to a second plate.

It is to be understood that the above-referenced arrangements are illustrative of the application for the principles of the present invention. Thus, while the present invention has been described above in connection with the exemplary embodiments of the invention, it will be apparent to those of ordinary skill in the art that numerous modifications and alternative arrangements can be made without departing from the principles and concepts of the invention as set forth in the claims.

What is claimed is:

1. A method of delivering a fluid, comprising the steps of:

a) applying a voltage across a fluid contact area of a fluid delivery pin, said fluid contact area comprising a dielectric material and having an outer surface, said outer surface having a native interfacial surface tension state and a voltage induced state having a reduction in interfacial surface tension;

b) contacting at least a portion of the fluid contact area with the fluid such that a volume of fluid wets the outer surface of the fluid contact area when the voltage is applied; and c) returning at least a portion of the outer surface to the native interfacial surface tension state by adjusting the voltage, thereby delivering at least a portion of the volume of fluid to a receiving location.

2. The method of claim 1, wherein the step of contacting at least a portion of the fluid contact area is performed subsequent to the step of applying a voltage.

3. The method of claim 1, wherein the step of contacting at least a portion of the fluid contact area is performed prior to the step of applying a voltage.

4. The method of claim 1, wherein the fluid contact area is an external surface of the fluid delivery pin.

5. The method of claim 1, wherein the fluid contact area is an internal capillary surface of the fluid delivery pin.

6. The method of claim 1, wherein the fluid contact area has a configuration of a member selected from the group consisting of rod, needle, capillary, slotted, grooved, threaded, and combinations thereof.

7. The method of claim 1, wherein the volume of fluid has a volume from about 100 pL to about 100 μL.

8. The method of claim 1, wherein the step of applying the voltage includes applying an amount of voltage that is configured to pick up a predetermined volume of fluid.

9. The method of claim 1, wherein the step of adjusting the voltage returns the entire outer surface to the native interfacial surface tension state.

10. The method of claim 1, wherein the dielectric material is a hydrophobic material.

11. The method of claim 1, wherein the fluid contact area is provided by a single fluid delivery pin and further comprises a plurality of discrete individually addressable areas configured for delivery of a plurality of volumes of fluid such that each discrete individually addressable area can have a voltage applied thereto independently, and wherein the step of applying the voltage includes:

applying the voltage to a predetermined number of the plurality of discrete individually addressable areas that is less than a total number of the plurality of discrete individually addressable areas such that a predetermined volume of the fluid wets the outer surface when the fluid contact area is contacted with the fluid.

12. The method of claim 1, wherein the fluid delivery pin is configured to pick up a range of fluid volumes using different amounts of applied voltage, the method further comprising the steps of:

(a) selecting a volume of fluid to be picked up; and (b) selecting an amount of the voltage to be applied according to the volume of fluid selected.

13. An electro-wetting fluid delivery device, comprising:

a) a fluid delivery pin including a plurality of discrete individually addressable electrically conductive substrates stacked vertically along the fluid delivery pin, and a fluid contact area on the substrates, said fluid contact area including a dielectric layer adjacent the conductive substrates;

b) a non-conductive spacer between each of the plurality of discrete individually addressable electrically conductive substrates;

c) an electric field source operatively connected to each of the electrically conductive substrates, the electric field source configured to individually apply a voltage to the respective electrically conductive substrates to produce for producing an electric field across at least a portion of the fluid contact area, wherein each of the plurality of discrete individually addressable electrically conductive substrates is configured to exhibit electro-wetting when the voltage is individually applied thereto; and d) a feedback system operatively connected to the electric field source and configured for variable adjustment of the electric field based on measurement of a resistance or capacitance of the fluid contact area and fluid thereon.

14. The device of claim 13, wherein the fluid contact area has a configuration of a member selected from the group consisting of rod, needle, capillary, slotted, grooved, threaded, and combinations thereof.

15. The device of claim 13, further comprising a plurality of fluid delivery pins arranged in an array on a common pin block.

16. The device of claim 13, wherein each of the electrically conductive substrates comprises a member selected from the group consisting of stainless steel, copper, doped-polysilicon, aluminum, gold, and conductive alloys or composites thereof.

17. The device of claim 13, wherein the dielectric layer comprises a material having a dielectric constant of greater than about 15.

18. The device of claim 13, wherein the dielectric layer comprises a member selected from the group consisting of polytetrafluoroethylene, silicon nitride, silicon dioxide, fluorosilicate glass, diamond-like carbon, polystyrene, fluorinated polyimides, parylene, polyarylene ether, siloxanes, silsesquioxanes, aerogels, xerogels, polyimide, epoxy, polyurethane, polyester, cyanoacrylate, polynorbornenes, fluorinated polymers, and combinations thereof.

19. The device of claim 13, further comprising a hydrophobic material coated at least partially on the dielectric layer.

20. The device of claim 13, wherein the electric field source is configured for variable adjustment of the electric field.

21. The device of claim 13, wherein the plurality of discrete individually addressable areas is configured for delivery of a plurality of different volumes of fluid.

* * * * *

UNITED STATES PATENT AND TRADEMARK OFFICE

CERTIFICATE OF CORRECTION

PATENT NO. : 7,780,830 B2
APPLICATION NO. : 11/228699
DATED : August 24, 2010
INVENTOR(S) : Charles C. Haluzak et al.

It is certified that error appears in the above-identified patent and that said Letters Patent is hereby corrected as shown below:

In column 12, line 22, in Claim 13, before “an” delete “for producing”.

Signed and Sealed this
Twentieth Day of December, 2011

David J. Kappos

David J. Kappos
*Director of the United States Patent and Trademark Office*